United States Patent [19]

Vercoulen et al.

[11] Patent Number: 5,021,314

[45] Date of Patent: Jun. 4, 1991

[54] COLORED MAGNETICALLY ATTRACTABLE TONER POWDER

[75] Inventors: Gerardus C. P. Vercoulen, Velden; Robert P. Faessen, Best; Marcel L. M. Pennings, Horst; Arnold B. M. H. van der Meij, Venlo, all of Netherlands

[73] Assignee: Oce-Nederland B.V., Netherlands

[21] Appl. No.: 371,519

[22] Filed: Jun. 26, 1989

[30] Foreign Application Priority Data

Jul. 4, 1988 [NL] Netherlands ..... 8801683

[51] Int. Cl.[5] ..... G03G 9/083; G03G 9/09

[52] U.S. Cl. ..... 430/106; 430/106.6

[58] Field of Search ..... 430/106, 106.6

[56] References Cited

U.S. PATENT DOCUMENTS 4,443,527 4/1984 Heikens et al. ..... 430/106 X
4,623,602 11/1986 Bakker et al. ..... 430/106
4,865,937 9/1989 Santilli et al. ..... 430/106 X

FOREIGN PATENT DOCUMENTS 58-14842 1/1983 Japan .

*Primary Examiner*—Roland Martin
*Attorney, Agent, or Firm*—Reed, Smith, Shaw & McClay

[57] ABSTRACT

A colored magnetically attractable toner powder comprising magnetically attractable material finely distributed in, or enveloped by, a coloring substance of thermoplastic resin and yellow fluorescent dye. The combination of yellow fluorescent dye and thermoplastic resin is selected such that a standard mass which comprises titanium dioxide and said thermoplastic resin in a weight proportion of 1:4, and also comprises yellow fluorescent dye in such an amount that the maximum fluorescence is observed, has the following characteristics: light-reflection between 400 and 450 nm at most 15%, fluorescence peak between 500 and 580 nm, light-reflection at fluorescence peak at least 120°, lightness at least 90, chroma at least 90.

6 Claims, No Drawings

COLORED MAGNETICALLY ATTRACTABLE TONER POWDER

FIELD OF THE INVENTIONS

The invention relates to a colored magnetically attractable toner powder and, in particular, to individual toner particles which consist of magnetically attractable material enveloped by or finely distributed in a coloring substance comprising a thermoplastic resin and coloring material.

BACKGROUND OF THE INVENTION

Magnetically attractable toner powders have found widespread use for generating visible information on an information support. They are used, inter alia, not only in magnetographic printing or reproduction processes but also in electrophotographic and electrostatic processes in which the magnetic properties of the toner powder are utilized to enable the powder to be fed by means of magnetic conveying means to a developing or image-forming station. The readily magnetizable materials conventional in toner powders, such as carbonyl iron, ferrites and chromium dioxide, are brown to brown-black in color and fulfill the function of coloring material in black toner powders, usually in addition to carbon.

In the production of colored magnetically attractable toner powders, the presence of the dark tinted magnetically attractable material also gives rise to problems because its dark tint should be masked to enable colored toner powder to be obtained with a high brightness and good color saturation.

Japanese Patent Application No. 76/46131 proposes the production of colored toner powder by enveloping the magnetically attractable particles chemically with a white substance or dispersing the magnetically attractable material together with white pigment in a binder, grinding the mass into particles and finally coating these particles with a colored polymer layer.

A similar proposal is made in German Patent Application No. 3542834, in which colored toner powder is made by dispersing round or elliptical magnetically attractable particles and color pigment in a thermoplastic binder and grinding the mass into particles of the required particle size.

Colored toner powders having attractive bright and saturated colors are not obtained with the above proposals and this applies particularly when yellow or red toner powders are required. See also Japanese Patent Application Nos. 58/14842 which discloses toner powder comprising yellow fluorescent pigment or dye and 57/66441 which discloses using a fluorescent material having a wavelength peak less than or equal to 420 nm.

European Patent Application Nos. 75346 and 156408 describe colored magnetically attractable toner powder which consists of a magnetically attractable core, a masking layer which envelops the core and which contains binder and light-reflecting pigment, and coloring constituents which are disposed in and/or on the masking layer. The color characteristics of these layered toner powders are considerably better than those of the previously-mentioned toner powders. The objection is again that the manufacture of such toner powders is complicated. Bright saturated colors can also be obtained only if a fairly thick masking layer and a relatively thick coloring layer are applied successively. The treatments then result in relatively coarse toner particles which are unsuitable for reproducing high-resolution patterns. Yet another disadvantage of these toner powders is fixing by means of pressure and heat involves the risk of the toner particles being excessively spread out, so that the dark core is exposed more or less and consequently the color quality of the fixed images is clearly poorer than that of the toner powder itself. This disadvantage may occur particularly in the production of double-sided prints, in which the first side of a receiving support is first provided with a fixed image and then the other side. The first image formed is then subject to double fixing and as a result gives a distinctly poorer color quality than the last image formed.

It is, therefore, an object of the present invention to provide a colored magnetically attractable toner powder without the above disadvantages or in which the above disadvantages are significantly reduced.

SUMMARY OF THE INVENTION

According to the invention, a toner powder is provided in which the coloring material comprises a fluorescent dye of which a standard mass consisting of 20% by weight of titanium dioxide, 80% by weight of a thermoplastic resin and fluorescent dye in an amount such that maximum fluorescence is observed, has the following characteristics: light-reflection in the wavelength range between 400 and 450 nm is at most 15%, fluorescence peak in the wavelength range between 500 and 580 nm, light-reflection at the fluorescence peak at least 120%, lightness (L) at least 90 and chroma (C) at least 90.

The titanium dioxide in the standard coloring substance is rutile titanium dioxide of the type Kronos RN59 (Kronos A.G., West Germany)

According to the invention, colored magnetically attractable toner powders of high brightness and color saturation can be obtained in substantially any color tint varying between yellow, green, orange and red. The brightness and color saturation of the toner powders according to the invention are better than those of comparable toner powders according to the above-mentioned Japanese Patent Application Nos. 76/46131 58/14842 and 57/66441 and German Patent Application No. 3542834. In comparison with the toner powders described in the European Patent Application Nos. 75346 and 156408, the advantage of toner powder according to the invention is that the fixed images formed therewith give substantially the same color impression as the colored toner powder itself.

The coloring material of the toner powder according to the invention comprises a yellow to yellow-green fluorescent dye which has a fluorescence peak in the wavelength range between 500 and 580 nm and which gives a strong fluorescence in the binder selected. The combination of yellow fluorescent dye and binder type should be so selected that a standard mass which consists of titanium dioxide and binder in a weight ratio of 1:4 and which contains an amount of yellow-fluorescent dye such that maximum fluorescence occurs has the above-indicated characteristics. The characteristics of the standard mass are determined in an ICS Micro-Match Spectrometer, equipped with the standard D65 light source. The lightness (L) and chroma (C) are expressed in Cielab values.

It has been found that in the highly fluorescent combinations of dye and binder as used according to the invention it is possible to use relatively large amounts of white pigment without the color saturation of the coloring substance being brought to a very low level, and the resulting color consequently becoming a pastel tint. Thus, according to the invention it is possible to mask the dark tint of the magnetically attractable material with a relatively large quantity of white pigment and yet obtain a toner powder which, apart from considerable lightness, also has high color saturation. In the case of toner powders having a relatively low magnetically attractable material content, which material, in addition, has a low specific area, for example toner powders which contain 2–3% by volume of round or substantially round magnetically attractable particles with a particle size between 3 and 7 micrometers, it is possible according to the invention to obtain attractive colors even without the use of white pigment. Other advantages of this invention will become apparent from a perusal of the presently preferred embodiments of the invention.

PRESENTLY PREFERRED EMBODIMENTS

Yellow-fluorescent dyes with which it is Possible to obtain the above-described color characteristics are Macrolex Fluorescent Yellow 10GN (C.I. Solvent Yellow 160:1), Thermoplast f-Gelb 084 (C.I. No. 59075) and Maxilon Brilliant Flavine 10 GFF (C.I. Basic Yellow 40). Thermoplastic resins in which these dyes have the required high fluorescence are epoxy resins, polyester resins and modified polyester resins which in their polymer chain bear groups having a dipole moment in excess of 2, such as a sulphonyl, amide, anhydride or ureide group. Particularly in combination with the dye Maxilon Brilliant Flavine 10GFF, the latter resins are preferable to give the required high fluorescence.

Suitable epoxy resins are the relatively low molecular epoxy resins such as are available under the trade names Epikote 1001 and 1004 (Shell-Nederland). Also usable are the resins derived from such epoxy resins and obtained by blocking the epoxide groups with a monofunctional reagent such as p-cumylphenol, or largely blocking them with a mono-functional reagent of this kind and otherwise crosslinking them by inter-molecular reaction and/or reaction with a poly-functional epoxy hardener. Suitable thermoplastic resins derived from epoxy resins are described, for example, in UK patents 2007382, 2014325 and 2036353. These resins are all regarded as epoxy resins within the scope of the invention.

Suitable polyester resins are linear resins derived from a dicarboxylic acid and a diol, and branched polyester resins obtained by polymerisation of a dicarboxylic acid with a mixture of a diol and a small quantity, e.g. 5 mol %, of a more than dihydric alcohol, or by polymerization of a diol with a mixture of a dicarboxylic acid and a small quantity of a more than bivalent carboxylic acid. Suitable polyester resins are described, inter alia, in Netherlands Patent Application Nos. 6807896 and 7116891 and European Patent Application No. 146980. Polyester resins or modified polyester resins which in their polymer chain bear groups with a dipole moment in excess of 2 can be obtained by including in the reaction mixture a suitable quantity, e.g., 10 to 50 mol %, of a bifunctional or polyfunctional reagent bearing such polar groups or forming such groups during the polymerization reaction. Thus sulphonyl groups can be incorporated in the polymer chain by adding to the reaction mixture a diol bearing sulphonyl groups as described in Netherlands Patent Application No. 7116891. Modified polyester resins bearing amide groups in their polymer chain (hereinafter referred to as polyester amides) can be obtained by the standard polycondensation techniques for the preparation of polyesters, in which the diol is partly replaced (e.g. 10 to 50mol %) in the reaction mixture by a diamine or amino alcohol. Examples of suitable diamines and amino alcohols are tetramethylene diamine, hexamethylene diamine, p-phenylene diamine, 1-amino-2-ethanol, 1-amino-2-propanol and 1-amino3-propanol.

In addition to the yellow-fluorescent dye, the coloring material may contain coloring additives, depending upon the color in which the toner powder is required. For a green-colored toner powder a cyan or green colored pigment is added, while for an orange or red-colored toner powder a red or magenta fluorescent dye is included in the coloring material. To obtain a red toner powder with a high color saturation a red or magenta fluorescent dye which also has a strong fluorescence is added to the coloring material. Attractive red-violet fluorescent dyes are Rhodamine B (C.I. No. 45170), Basonyl Rot 560 (C.I. Basic Violet 11:1), 4-cyanocoumarins, such as 3-(benzothiazol-2-yl)-4-cyano-7N,N-diethylamino coumarin and Astra Phloxine (C.I. No. 48070).

The solubility of these dyes in the above resins can generally be increased by using them in the form of the tetrafluoroborate, perchlorate or hexafluorozirconate, instead of in the usual chloride form.

The total quantity of fluorescent dye in the toner powders according to the invention is of course dependent on the color shading required. Generally, the total quantity of fluorescent dye based on the quantity of binder will be between 3 and 7% by weight. In green toner powder the fluorescent dye may consist solely of yellow fluorescent dye. In yellow toner powder it may be desirable to add a small quantity of a red or magenta fluorescent dye in addition to the yellow fluorescent dye in order to compensate for the green hue and thus shift the color of the toner powder to more neutral yellow. In red colored toner powder the yellow dye is used in a quantity in which a good fluorescence is obtained in combination with a good color saturation. The quantity of yellow dye in red toner powder is usually 2 to 4% by weight based on the quantity of binder.

Apart from thermoplastic binder and coloring constituents as described above, the coloring substance may contain a quantity of white pigment to compensate for the dark tint of the magnetically attractable material. It has surprisingly been found that the addition of white pigment does not lead directly to any appreciable reduction of the color saturation, but that there is a wide concentration area for the white pigment at which the color saturation is maintained at a high level. According to the invention, therefore, it is possible to produce magnetically attractable toner powders of high brightness and good color saturation. If the toner powder contains only a small quantity of magnetically attractable material which also has a low specific area, it is possible according to the invention to produce attractively colored toner powders even without the addition of white pigment.

The toner powder according to the invention is prepared in a simple manner by finely distributing magnetically attractable material in a melt of the coloring substance, cooling the melt to a solid, and processing the solid by grinding and screening to give particles of the required particle size, e.g. 10 to 25 micrometers.

The toner powder can also be prepared by covering a magnetically attractable core, preferably having a particle size of between 5 and 15 micrometers, with a layer of coloring substance having a thickness of a few micrometers.

The following examples will further explain the toners of the invention and the process for preparing same.

EXAMPLES

The colored toner powders described hereinafter are all made by melting the thermoplastic resin, homogeneously distributing in the melt the magnetically attractable material, fluorescent dye and any other additives, then cooling the melt to a solid and processing the solid to give particles of a particle size between 10 and 25 micrometers.

I. Yellow Toner Powder

| | |
|---|---|
| 160 g | polyester resin (Atlac 500 T of I.C.I. England) |
| 80 g | titanium dioxide (Kronos RN 59) |
| 40 g | carbonyl iron with an average particle size of between 7 and 8 micrometers |
| 8 g | Macrolex Fluorescent Yellow 10 GN |
| 0.40 g | Basonyl Rot 560-perchlorate |

Characteristics of the standard mass:

Light-reflection between 400 and 450 nm: <11%; fluorescence peak: 520 nm; light-reflection at fluorescence peak: 147%; L = 103.5; C = 96.

| | | | | | |
|---|---|---|---|---|---|
| Toner powder: | L = 70.9 | C = 77.5 | H = 89.1 | A = 1.2 | B = 77.5 |
| Print after 1× fixing: | L = 81.5 | C = 71.4 | H = 91.8 | A = −3.2 | B = 71.4 |
| Print after 2× fixing: | L = 80 | C = 72 | H = 91.1 | A = −2.1 | B = 71.2 |

A substantially identical result was obtained by using in the above formulation 15 g of Thermoplast f-Gelb 084 instead of 8 g Macrolex Fluorescent Yellow 10 GN.

The characteristics of the standard mass containing Thermoplast f-Gelf 084 are:

Light-reflection between 400 and 450 nm: <11.2%; fluorescence peak: 560 nm; light-reflection at fluorescence peak: 137.4%; L=99.9; C=93.7.

II. Red Toner Powder

| | |
|---|---|
| A. 180 g | Polyester amide of propoxylated Bisfenol A (25 mol %) 1-amino-3-propanol (25 mol %), terephthalic acid (45 mol %) and adipic acid (5 mol %) |
| 6.76 g | Maxilon Brilliant Flavine 120 GFF |
| 4.52 g | Basonyl Rot 560 |
| 42 g | Carbonyl iron with an average particle size of between 3 and 4 micrometers |
| 40 g | Titanium dioxide (Kronos RN 59) |

Characteristics of the standard mass: light-reflection between 400 and 450 nm: <9%; fluorescence peak: 520 nm; light-reflection at fluorescence peak: 166%, L = 144; C = 103.

| | | | | | |
|---|---|---|---|---|---|
| Toner powder: | L = 50.5 | C = 47.4 | H = 29.7 | A = 41.2 | B = 23.5 |
| Print after 1× fixing: | L = 50.8 | C = 43.8 | H = 25.6 | A = 39.5 | B = 18.9 |
| Print after 2× fixing: | L = 49.9 | C = 44.4 | H = 25.4 | A = 39.2 | B = 18.7 |

B. As in A, but with 24 g titanium dioxide instead of 40 g.

| | | | | | |
|---|---|---|---|---|---|
| Toner powder: | L = 47.4 | C = 45.2 | H = 30.5 | A = 38.9 | B = 22.9 |
| Print after 1× fixing: | L = 48.2 | C = 42.1 | H = 26.6 | A = 38.6 | B = 22.5 |
| Print after 2× fixing: | L = 47.9 | C = 42.6 | H = 26.4 | A = 38.3 | B = 22.3 |

| | |
|---|---|
| C. 160 g | Polyester resin (Atlac 500 T) |
| 20 g | Carbonyl iron with an average particle size of about 3 micrometers |
| 2.4 g | Astra Phloxine |
| 0.8 g | Basonyl Rot 560-perchlorate |
| 3.2 g | Macrolex Fluorescent Yellow 10 GN |

| | | | | | |
|---|---|---|---|---|---|
| Print after 1× fixing: | L = 46.0 | C = 45.3 | H = 28.5 | A = 39.8 | B = 21.7 |
| Print after 2× fixing: | L = 45.6 | C = 45.8 | H = 28.1 | A = 39.5 | B = 21.5 |

III. Green Toner Powder

| | |
|---|---|
| 180 g | Polyester resin (Atlac 500 T) |
| 90 g | Titanium dioxide (Kronos R 59) |
| 45 g | Carbonyl iron with an average particle size of between 2 and 3 micrometers |
| 9 g | Macrolex Fluorescent Yellow 10 GN |
| 25.5 g | Colanyl Groen 30 GG |

| | | | | | |
|---|---|---|---|---|---|
| Toner Powder: | L = 44.6 | C = 53.7 | H = 137.5 | A = 39.6 | B = 36.3 |
| Print after 1× fixing: | L = 56.2 | C = 50.2 | H = 141.8 | A = 39.4 | B = 31 |
| Print after 2× fixing: | L = 55.1 | C = 50.6 | H = 141.5 | A = 39.1 | B = 30.8 |

EXAMPLES FOR COMPARISON

A. On analogy with Example 4b of DE-A 3542834, toner powder was prepared in accordance with the following formulation:

| | | | |
|---|---|---|---|
| 150 g | polyester amide in accordance with the above Example IIA | | |
| 72 g | of titanium dioxide (Kronos RN 59) | | |
| 180 g | carbonyl iron with an average particle size of between 7 and 8 micrometers | | |
| 20 g | azo-dye prepared from diazotized 2,4,5-trichloroaniline and 3-hydroxy-2-naphthoic acid-o-toluidide | | |
| Toner powder: | L = 38.9 | C = 28.8 | H = 9.8 |
| In the above formulation the 20 g of azo-dye were replaced by: | | | |
| 5.8 g | Basonyl Rot 560-perchlorate | | |
| 3 g | Maxilon Brilliant Flavine 10 GFF | | |
| Toner Powder: | L = 49.8 | C = 33.6 | H = 20.9 |

The toner powder according to the invention, thus, has a considerably higher brightness and a better color saturation than the known toner powder.

B. Red colored toner powder was prepared with the following composition in the manner described in Example 2 of EP-A 75346:

Magnetically attractable core with a particle size of between 9 and 20 micrometers and consisting of 50% by weight of carbonyl iron, type HF2 of BASF, West Germany, and 50% by weight of epoxy resin, type Epikote 1001 of Shell-Nederland.

Masking layer formed by means of a qranulate of the composition, 80 g epoxy resin, type Epikote 1004 of Shell-Nederland and 120 g titanium dioxide, type Kronos RN 59.

Coloring layer formed by means of a granulate of the composition: 100 g of polyester amide in accordance with the above Example IIA, 2.5 g Basonyl Rot 560 and 3.75 g Maxilon Brilliant Flavine 10 GFF.

Toner powder : L=41.4 C=42.6 H=28.2

Print after 1x fixing: L=51.8 C=35.9 H=23.6

Print after 2x fixing: L=51.9 C=26.9 H=20.1

While presently preferred embodiments of the invention have been described in particularity, the invention may be otherwise embodied within the scope of the appended claims.

What is claimed is:

1. A colored magnetically attractable toner powder, comprising individual particles of magnetically attractable material enveloped by or finely distributed in a coloring substance, said coloring substance comprising a thermoplastic resin and coloring material, said coloring material comprising a first colorant and a second yellow-fluorescent colorant of which a standard mass consisting of 20% by weight of titanium dioxide, 80% by weight of thermoplastic resin and fluorescent colorant in an amount such that maximum fluorescence is observed, has the following characteristics: light-reflection in the wavelength range between 400 and 450 nm at most 15%, fluorescence peak in the wavelength range between 500 and 580 nm, light-reflection at the fluorescence peak at least 120%, lightness (L) at least 90 and chrona (C) at least 90.

2. A toner powder according to claim 1, wherein said yellow-fluorescent colorant is selected from the group consisting of Maxilon Brilliant Flavine 10 GFF (C.I. basic yellow 40), Macrolex Fluorescent Yellow 10 GN (C.I. Solvent 160:1) and Thermoplast f-Gelb 084 (C.I. No. 59075).

3. A toner powder according to claim 1, wherein said first colorant comprises a red or magenta fluorescent dye.

4. A toner powder according to claim 3, wherein said red or magenta fluorescent colorant is selected from the group consisting of Rhodamine B (C.I. No. 45170), Basonyl Rot 560 (C.I. Basic Violet 11:1), Astra Phloxine (C.I. No. 48070) and 4-cyanocoumarins.

5. A toner powder according to claims 1, 2, 3 or 4, wherein said thermoplastic resin is selected from the group consisting of epoxy resins, polyester resins and modified polyester resins having within their polymer chain groups having a dipole moment in excess of 2.

6. A toner powder according to claims 1, 2, 3 or 4, characterized in that the coloring substance also comprises white pigment.

* * * * *